United States Patent [19]

Martikainen

[11] 4,351,172

[45] Sep. 28, 1982

[54] CYLINDER LOCK MECHANISM

[75] Inventor: Kaarlo Martikainen, Mastotie, Finland

[73] Assignee: Oy Wartisila AB, Helsinki, Finland

[21] Appl. No.: 181,803

[22] Filed: Aug. 27, 1980

[30] Foreign Application Priority Data

Sep. 7, 1979 [FI] Finland ..... 792797

[51] Int. Cl.[3] ..... E05B 29/02

[52] U.S. Cl. ..... 70/366; 70/402

[58] Field of Search ..... 70/362, 365, 366, 402, 70/403, 404, 376, 377

[56] References Cited

U.S. PATENT DOCUMENTS

| | | | |
|---|---|---|---|
| 3,789,638 | 2/1974 | Roberts | 70/366 |
| 3,797,290 | 3/1974 | Taylor | 70/366 |
| 4,267,717 | 5/1981 | Martikainan | 70/366 |

*Primary Examiner*—Robert L. Wolfe

*Attorney, Agent, or Firm*—McAulay, Fields, Fisher, Goldstein & Nissen

[57] ABSTRACT

A key operated cylinder lock is disclosed, including a hollow stationary cylinder housing enclosing a turnable power transmission element and a locking bar having a position locking the turning movement of said power transmission element relative to said cylinder housing. The cylinder lock further includes a set of discs including a number of locking discs turnable by means of combination surfaces on a key of said lock, the locking discs being turnable, by the turning movement of said key, from an initial key insertion position to a releasing position, in which the power transmission element is released from its locked connection to the cylinder housing, whereby the key of the lock is arranged to directly transmit a turning force to a number of locking discs only in a direction from said initial position to said releasing position. The returning of these locking discs to their initial position is arranged to be carried out by means of a separate return bar, receiving turning power from said key through one or several members turning with the key. Thereby the lock is operable in both turning directions and, in addition, the correct turning angle, that is the combination value of a number of locking discs, can be different in opposite turning directions. The separate return bar is movable in a circumferential as well as a radial direction of the lock.

22 Claims, 36 Drawing Figures

CYLINDER LOCK MECHANISM

Figure 1:
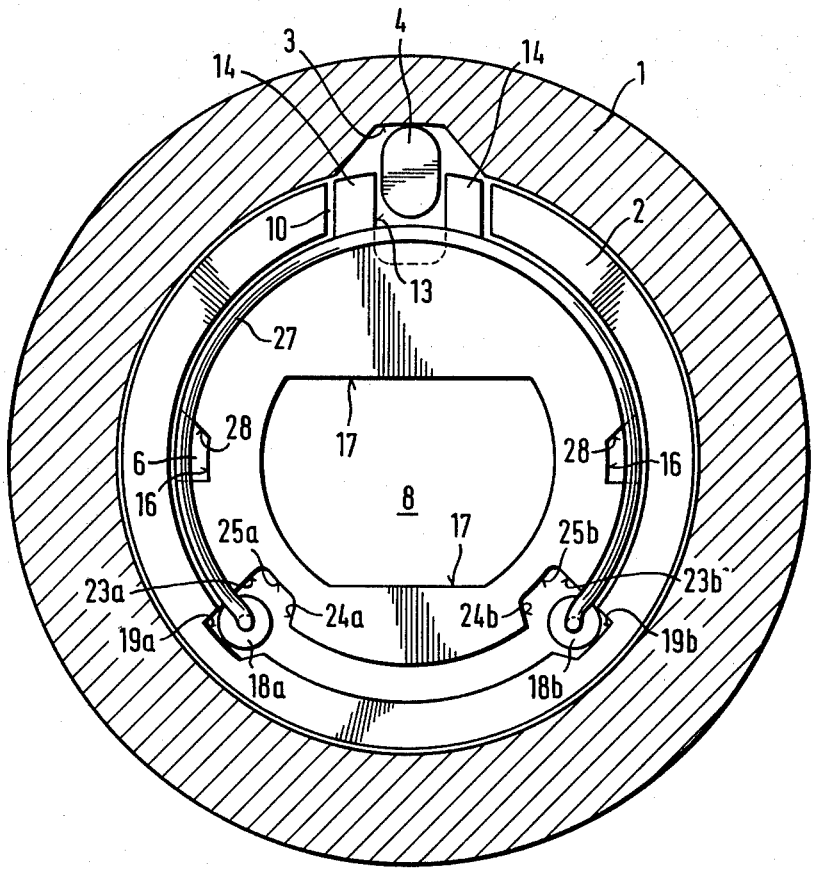

The invention relates to a key operated cylinder lock including a hollow stationary cylinder housing enclosing a turnable power transmission element and a locking bar having a position locking the turning movement of said power transmission element relative to said cylinder housing, further a set of discs including a number of locking discs turnable by means of combination surfaces on a key of said lock, the locking discs being turnable, by the turning movement of said key, from an initial key insertion position to a releasing position, in which the power transmission element is released from its locked connection to the cylinder housing.

A general drawback in known disc cylinder locks, in which the locking discs are turned into a releasing position by turning the key of the lock, is the fact that the lock is operable only in one turning direction. This is due to the fact that the locking discs have to be returned back into their initial position by turning the key back respectively. Consequently, the form of the key has to be such that the key serves as a member operating the lock mechanism only in one turning direction. There are numerous propositions for special arrangements according to which a key and lock mechanism operable in opposite turning directions can be obtained by additional movements of the key or by means of additional members in the lock. However, none of these known arrangements has proved to be satisfactory, as a rule due to the fact that the construction is too complicated or that the construction includes elements that wear out too soon or the operational security of which is insufficient.

An object of the invention is to provide a disc cylinder lock operable in whichever turning direction by means of the same key of the lock, but which, if required, easily can be arranged to be operable only in one turning direction, and the construction of which is uncomplicated and secure. According to the invention the key of the lock is arranged to directly transmit a turning force to a number of locking discs only in a direction from said initial position to said releasing position, and the returning of these locking discs to their initial position is arranged to be carried out by means of a separate return bar, receiving turning power from said key through one or several members turning with the key. Accordingly, in the lock according to the invention, returning of the locking discs is arranged in a new way. The result is that only a few axially short portions are needed in the key for the returning surfaces. These portions can advantageously be located, for instance, at both ends of that portion of the key which is inserted into the lock. Thereby the key can be provided with adjacent series of combination surfaces acting on the locking discs and turning them into a releasing position in the opposite turning directions.

The releasing combination of the lock can be equal in the opposite turning directions, but this is not a matter of necessity in a lock according to the invention. On the contrary, it is to be recommended to have a different turning angle for a number of locking discs in the opposite turning directions, or that the key has a different combination when operated in the clock-wise direction than when operated in the counter clock-wise direction.

One inconvenience related to disc cylinder locks described above is the fact that the zero-position, i.e. the insertion and the removal position of the key, is slightly indefinite thereby making it difficult for the user of the lock to detect said position. For eliminating this problem the lock can advantageously be provided with a guiding surface arranged to allow the insertion as well as the removal of the key only in a position corresponding to the zero-position or the initial position of the locking discs.

The invention can advantageously be adapted to a conventional cylinder lock provided with a turnable inner cylinder. This means that a hollow cylinder member is connected to the power transmission element of the lock, the locking discs being arranged inside of said cylinder member. In an embodiment of this kind the return bar can be arranged to move in a space between the peripheral edge of the locking discs and the inner surface of the hollow cylinder member. It is of advantage to have two return bars being arranged to positively guide the returning movements of the locking discs, each return bar in its own returning direction. As the return bars can easily be arranged to guide the locking discs the radial guidance of the locking discs advantageously is improved when using two return bars. In practice this is preferably carried out by arranging the return bars in their basic position together with the locking bar in such a way as to divide the periphery of the lock mechanism into three portions of at least substantially equal size. By this means a most favourable guidance is obtained for the locking discs.

To obtain a lighter lock operation as well as to make it easier to detect the zero-position of the lock described above the return bars can advantageously be urged by spring means, preferably in a direction radially outwards. Said spring means can be a U-shaped or circular shaped spring element, which, at the same time, can be arranged to urge also the locking bar in a direction radially outwards. By this means a useful spring load of suitable magnitude is obtained. A most favourable load distribution is obtained when the return bars are urged by spring means at both ends thereof. On the other hand, the return bars can advantageously be positively guided all the way so that no spring means for this purpose is required. In this case the lock includes a separate spring for the locking bar. It is also possible to have only one return bar, which is urged by spring means in a direction radially inwards. Also in this case the return bar can be arranged to be positively guided without said spring means.

The invention can also be adapted to a lock including no inner cylinder at all, whereby the locking discs are, in a way known per se, directly guided by the cylinder housing and the return bar is guided by means of the locking discs and intermediate discs located between the locking discs. By providing the locking discs and the intermediate discs with suitable guiding edges a construction can be obtained, in which said edges jointly form a closed channel for the return bar to move. Also an embodiment of this kind can be provided with two return bars being urged by spring means preferably in a direction radially outwards, said return bars further being arranged positively to guide the returning movements of the locking discs, each return bar in its own returning direction. In this case, too, the operation of the return bars can be arranged to be positively guided without any spring means. Only one return bar can be arranged to be used as well, then being urged by spring means preferably in a direction radially outwards, or the operation of the return bar is arranged to be positively guided all the way without any spring means.

A most favourable operation is generally obtained when the cross section of the return bar is substantially circular.

The lock according to the invention can easily be transformed to be operable, if required, in only one turning direction. This can be arranged by blocking, e.g. by means of a separate locking member or by suitably formed guiding edges of the power transmitting member, turning of the return bar relative to the set of discs in one operation direction of the lock so as to prevent the operation of the lock in said operation direction.

A key for a cylinder lock according to the invention can advantageously be formed so that the basic form of that portion of the key which is to be inserted into the lock is a hollow cylinder having an axial groove, from both edges of which portions of different size are removed for obtaining the combination surfaces of the key. Such a key can easily be manufactured and especially the combination surfaces can without difficulties be formed for the opposite operation directions. Another possible embodiment is a key, the basic form of that portion of said key which is to be inserted into the lock corresponding to a cylinder, from which a cylinder segment, preferably two cylinder segments of different size, is cut away. This embodiment is advantageous in a sense that the key cannot be inserted into the lock in a wrong position. A third embodiment is a key the basic form of that portion of said key which is to be inserted into the lock corresponding to a cylinder, as described above, but from both sides of which portions, e.g. cylinder segments, of equal size are cut away. The blade of the key thereby obtained can advantageously be provided with four series of combination surfaces, which are located symmetrically relative to the longitudinal axis of the key. If those series of combination surfaces which are located diametrically relative to the blade of the key are equal, the key can be inserted into the lock in two separate positions which can be obtained relative to each other by turning the key 180 degrees around its longitudinal axis. As a consequence of this arrangement there are, however, some restrictions for the combination surface pairs turning the same locking discs in opposite directions, but these restrictions are described more in detail later on in the specification.

Figure 2:
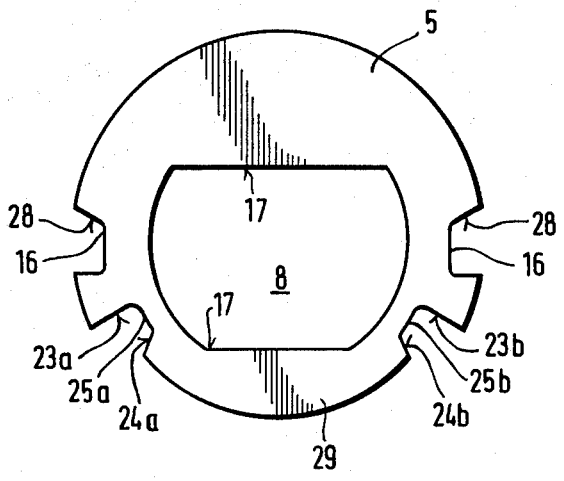
Figure 3:
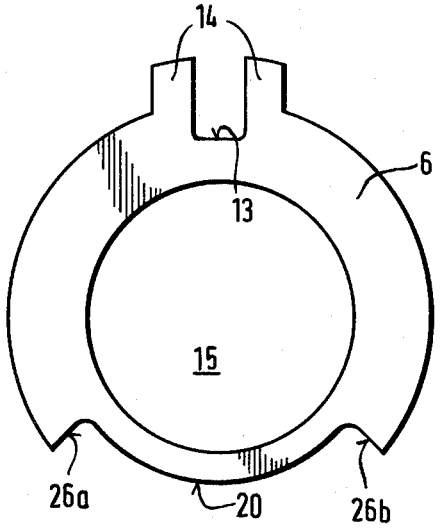
Figure 4:
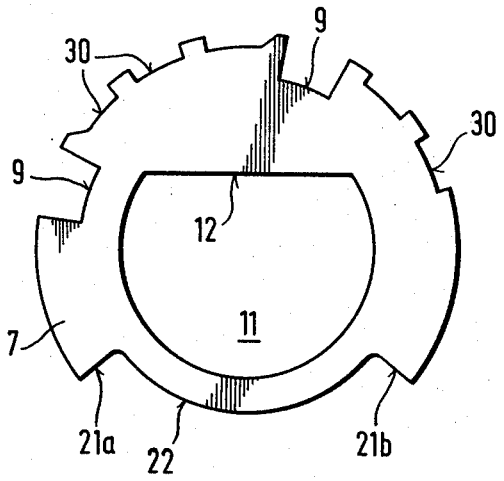
Figure 5:
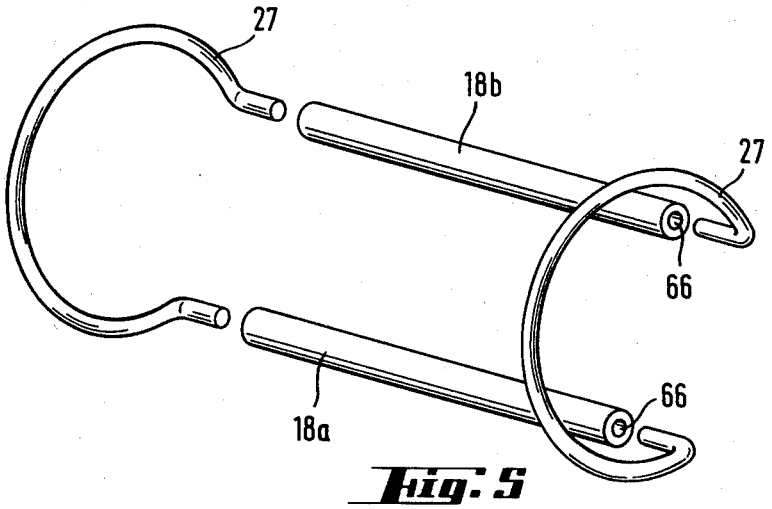
Figure 7:
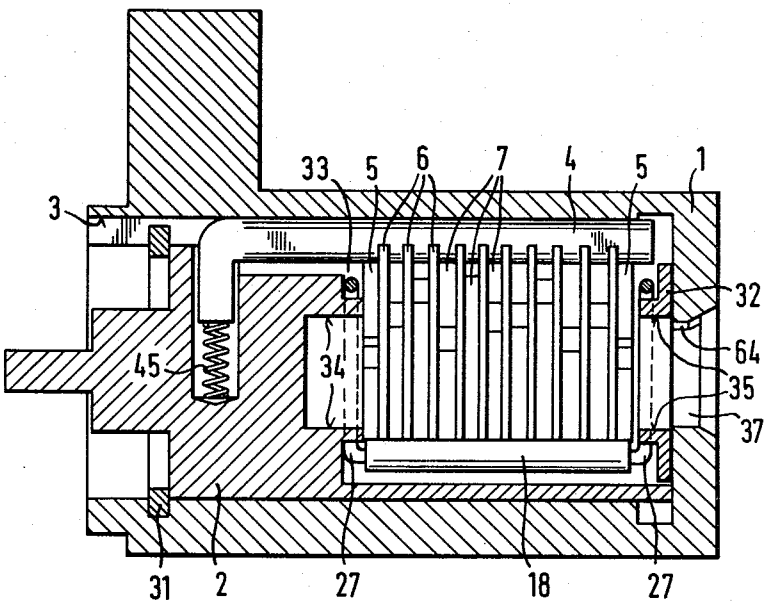
Figure 6:
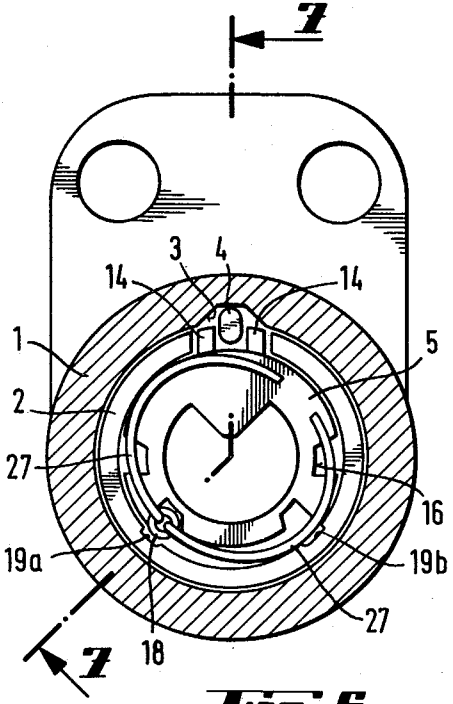
Figure 8:
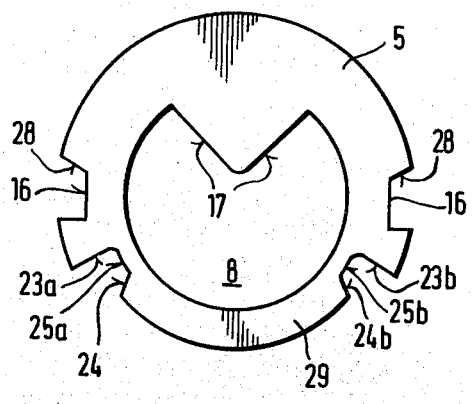
Figure 9:
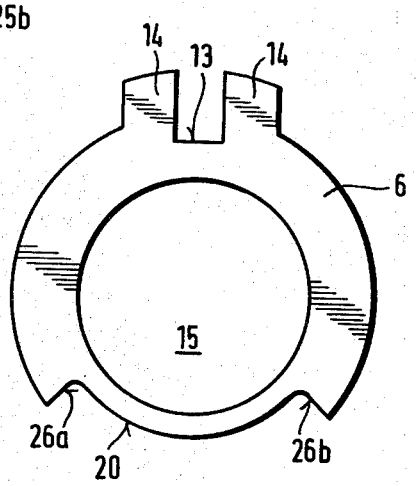
Figure 10:
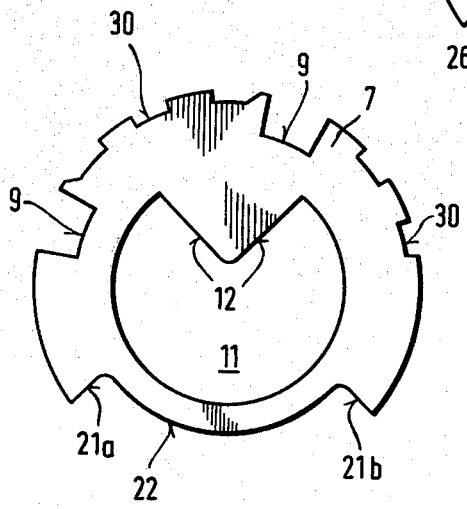
Figure 11:
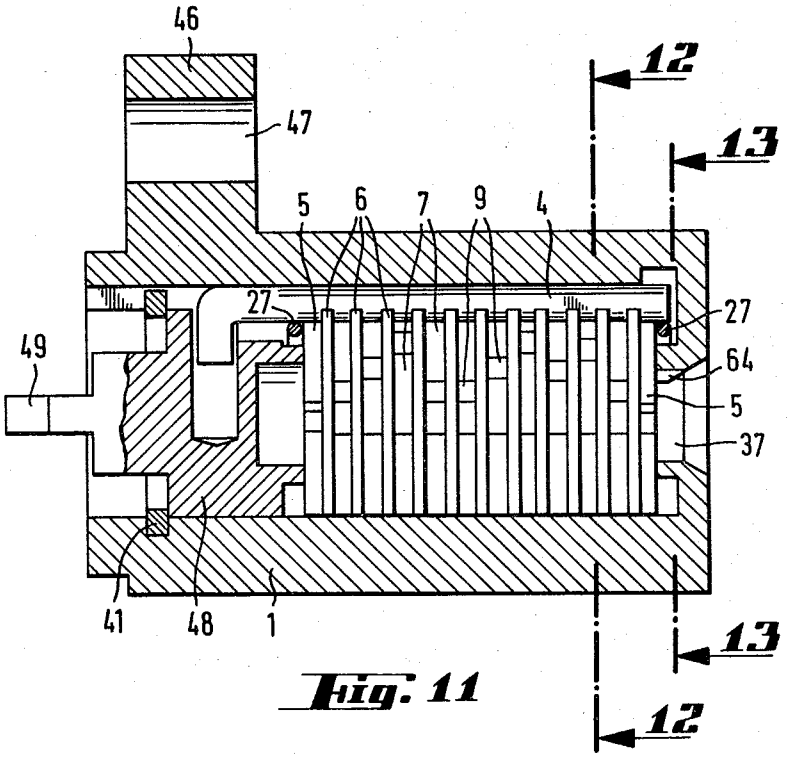
Figure 12:
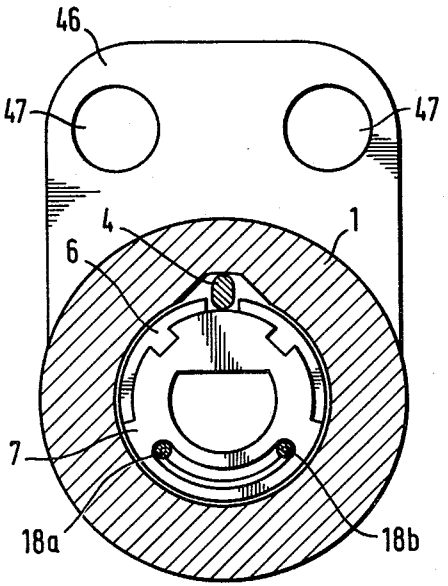
Figure 13:
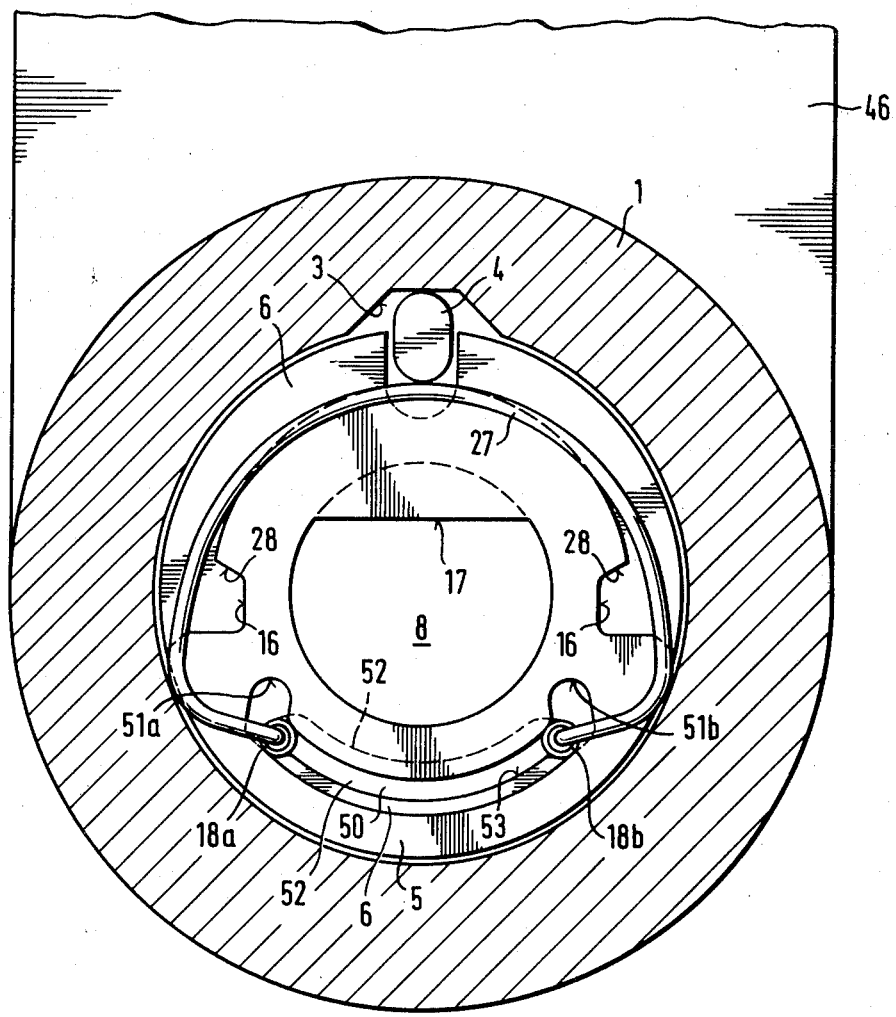
Figure 14:
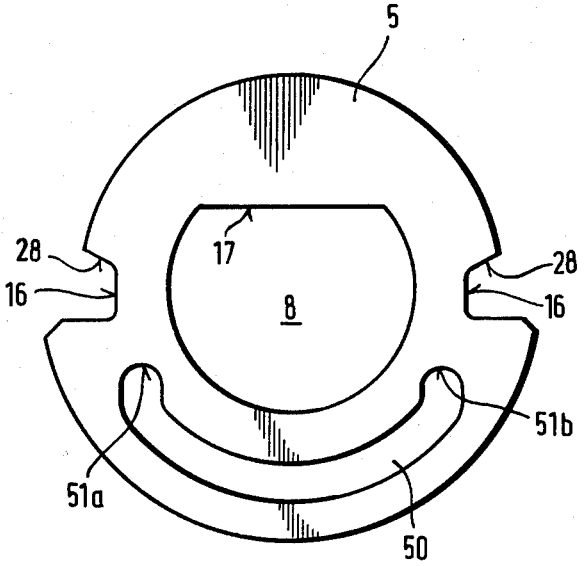
Figure 17:
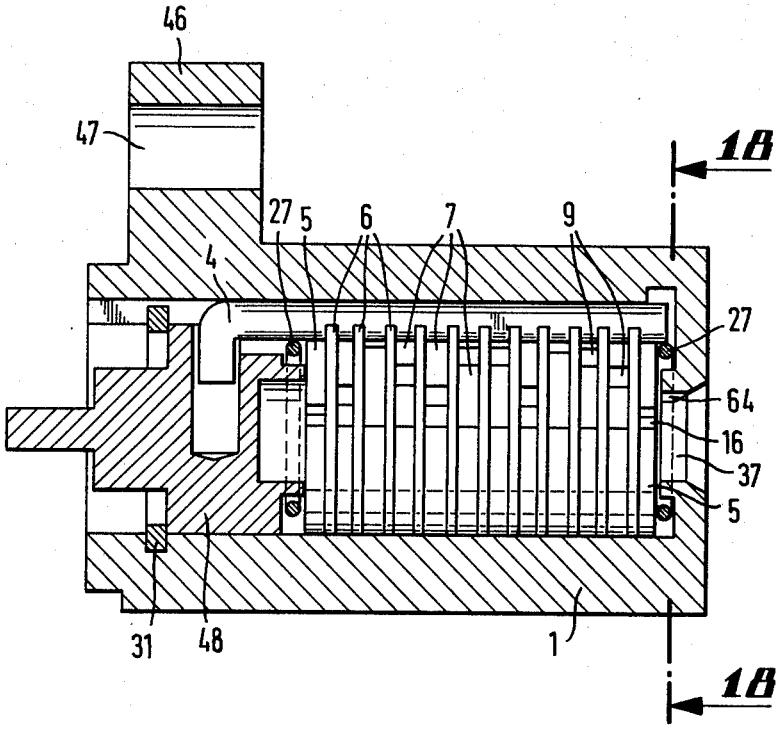
Figure 18:
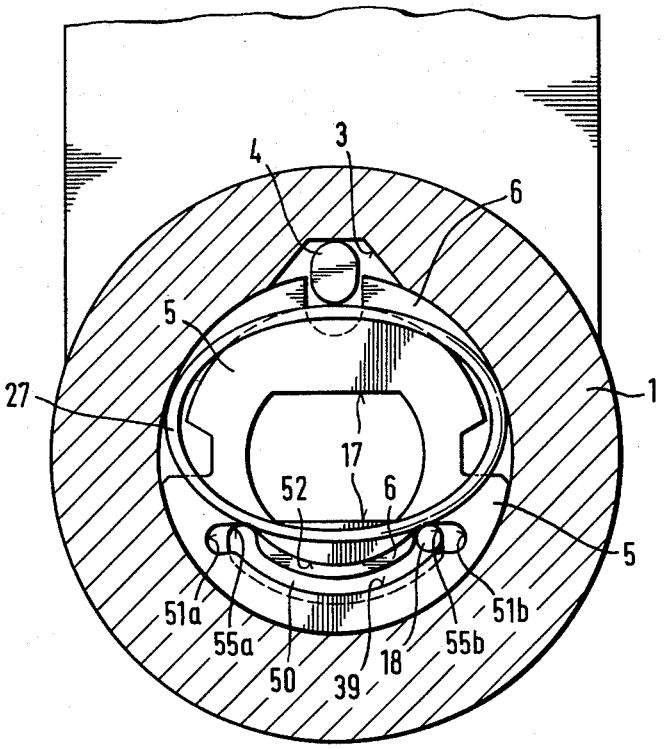
Figure 19:
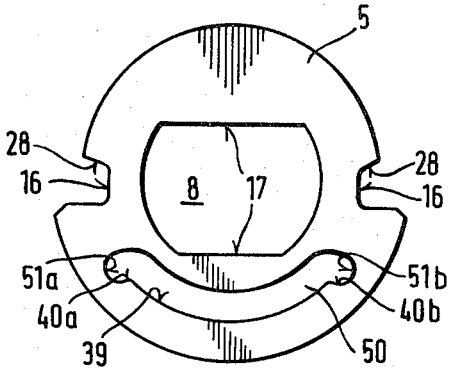
Figure 20:
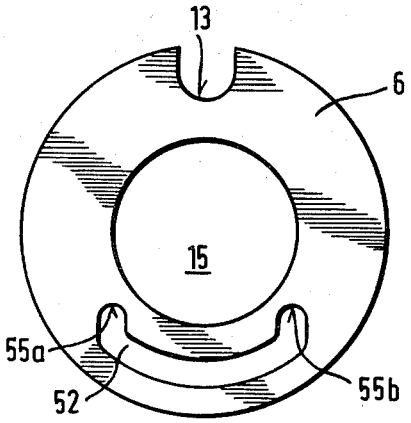
Figure 21:
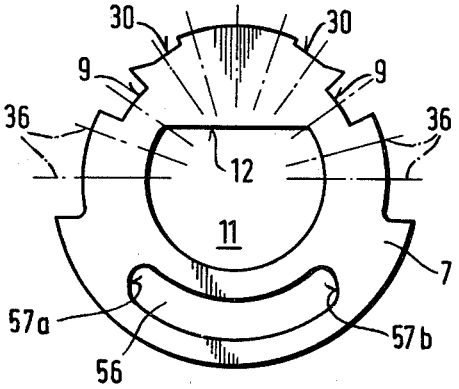
Figure 22:
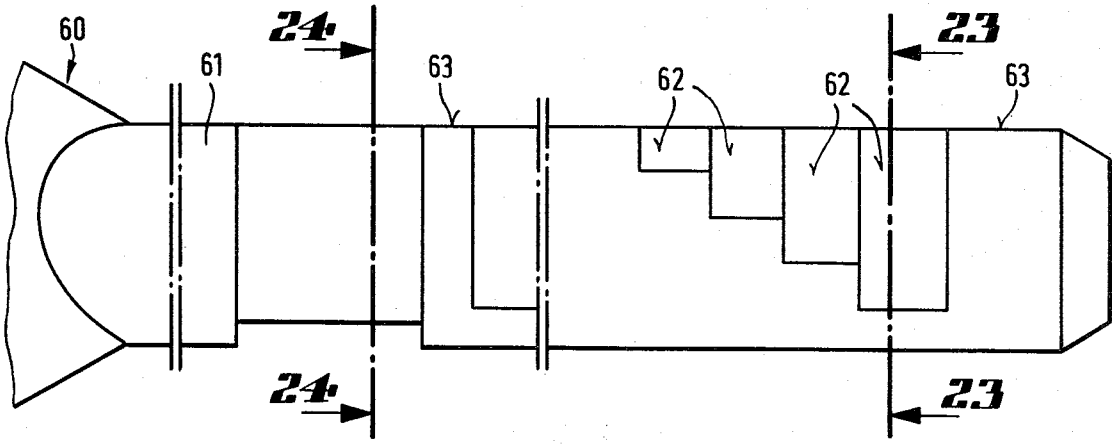
Figure 23:
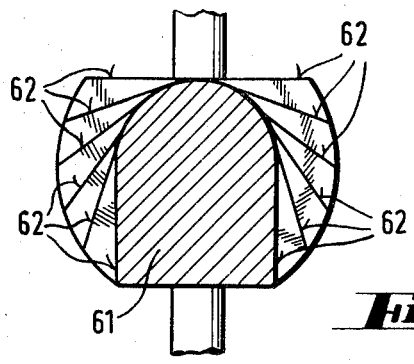
Figure 24:
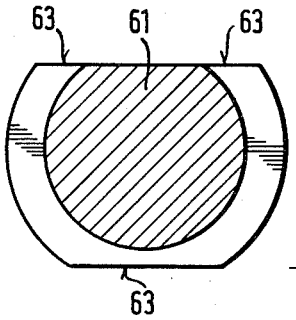
Figure 25:
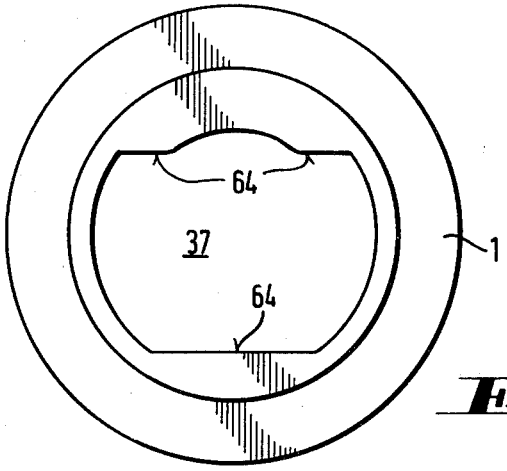
Figure 26:
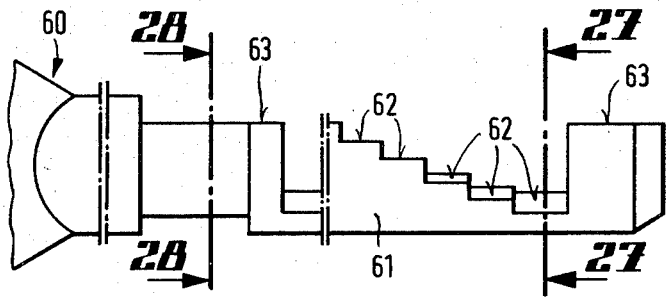
Figure 27:
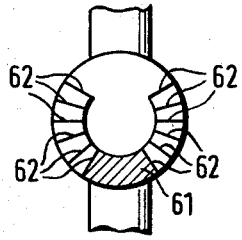
Figure 28:
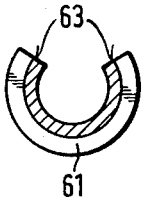
Figure 29:
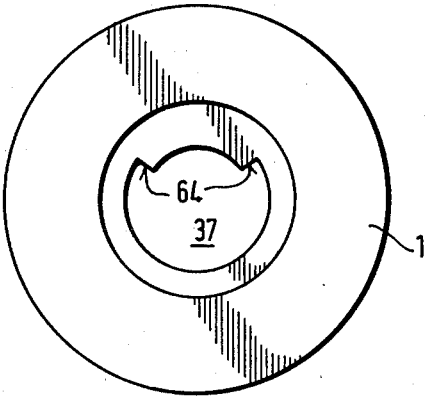
Figure 30:
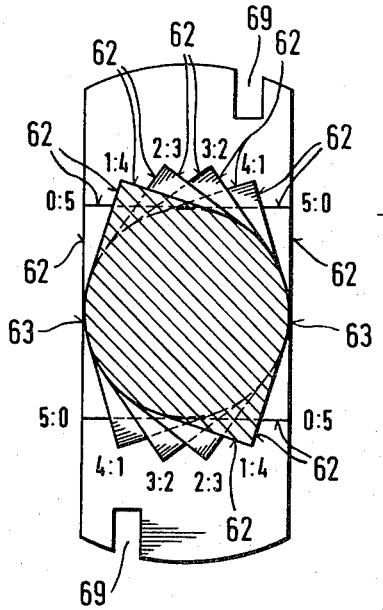
Figure 31:
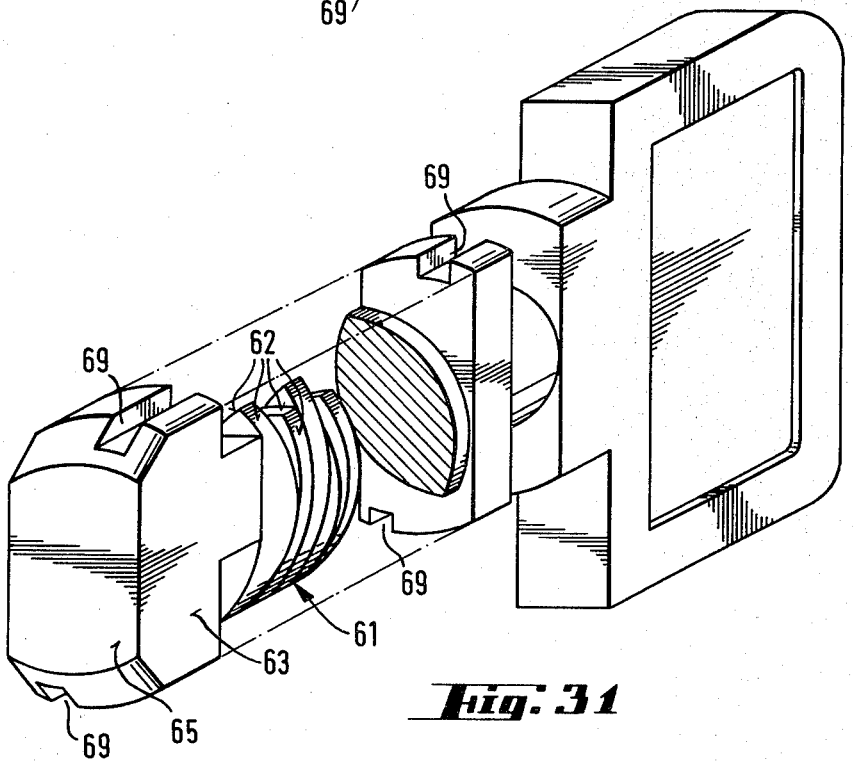

In the following the invention is described in greater detail with reference to the attached drawings, in which;

FIG. 1 shows as a sectional view an embodiment of a disc cylinder lock according to the invention, FIGS. 2–4 show discs of the cylinder lock of FIG. 1, FIG. 5 shows an arrangement for the springload for the returning bars of the locking discs in the embodiment according to FIGS. 1–4, FIG. 6 shows a sectional view of a second embodiment of a disc cylinder lock according to the invention, FIG. 7 shows section 7—7 of FIG. 6, FIGS. 8–10 show discs of the cylinder lock according to FIGS. 6 and 7, FIG. 11 shows as an axial section a third embodiment of a disc cylinder lock according to the invention, FIG. 12 shows section 12—12 of FIG. 11, FIG. 13 shows section 13—13 of FIG. 11, FIGS. 14–16 show discs of the cylinder lock according to FIGS. 11–13, FIG. 17 shows as an axial section a fourth embodiment of a disc cylinder lock according to the invention, FIG. 18 shows section 18—18 of FIG. 17, FIGS. 19–21 show discs of the cylinder lock according to FIGS. 17 and 18, FIG. 22 shows an embodiment of a key for the cylinder lock according to the invention, FIG. 23 shows section 23—23 of FIG. 22, FIG. 24 shows section 24—24 of FIG. 22, FIG. 25 shows a key insertion opening in the cylinder housing of the lock corresponding to the key according to FIGS. 22–24, FIG. 26 shows a second embodiment of a key for the cylinder lock according to the invention, FIG. 27 shows section 27—27 of FIG. 26, FIG. 28 shows section 28—28 of FIG. 26, FIG. 29 shows a key insertion opening in the cylinder housing of the lock corresponding to the key according to FIGS. 26–28, FIG. 30 shows as a view of principle a third embodiment of a key for the cylinder lock according to the invention, FIG. 31 shows a key according to the embodiment of FIG. 30, FIGS. 32–36 show alternative embodiments for arranging the embodiment of the cylinder lock according to FIGS. 11–16 to be operable in only one operation direction.

In the drawing the reference numeral 1 designates a cylinder housing enclosing, as conventional for disc cylinder locks with the exception of the embodiments shown in FIGS. 11–21 and 32–36, a turnable hollow inner cylinder including a number of locking discs 7 turnable with a key of the lock. The periphery of the locking discs 7 include peripheral notches 9 for both the operation directions of the lock, the location thereof determining the opening combination of the lock. The locking discs include a central opening 11 for the key, the edge surfaces of which serve as stop faces 12 for the combination surfaces of the key when turning the locking discs into a position releasing the inner cylinder 2. The turning of the inner cylinder 2 relative to the cylinder housing 1 is prevented, when the lock mechanism is in the locking position, in a way known per se, i.e. with a locking bar 4 located partly in an axial groove 3 in the inner surface of the cylinder housing 1, partly in a slot 10 going through the periphery of the inner cylinder 2. When turning, with the key of the lock, the locking discs 7 into the releasing position the peripheral notches 9 of separate discs jointly form a groove to allow the locking bar 4 to be moved thereinto, whereby the inner cylinder is released and the lock opens.

The set of discs located inside the inner cylinder 2 includes as known per se also an intermediate disc 6 between each locking disc 7. All the intermediate discs are equal and include a central opening 15 for the key and a peripheral notch 13 for the locking bar 4 as well as protrusions 14 arranged in the slot 10 of the inner cylinder against the side surfaces thereof and preventing turning of the intermediate discs relative to the inner cylinder 2. The arrangement of the set of discs per se is shown in FIG. 7. Further the set of discs include at least one, preferably two locking bar operating locking discs 5 (FIG. 8), which in general are located at the ends of the set of discs. The locking bar operating locking disc 5 includes peripheral notches 16 for the locking bar 4 at both sides relative to a central opening 8. Stop faces 17 in the central opening 8 are arranged to operate, guided by the combination surfaces of the key, in such a way that the locking bar operating locking disc 5 always turns with the key.

In an ordinary disc cylinder lock operable only in one turning direction the locking discs are returned, after opening the lock, into their initial locking position directly with the key of the lock, the key blade including a so called returning surface for this purpose. On the other hand in a disc cylinder lock operable in both turning directions the arrangement described above cannot be used, because the combination surfaces of the key are located at both sides of the key blade (FIGS. 22–24 and FIGS. 26–28) so that there is no place left for a conventional returning surface directly turning the locking discs into said initial position. Consequently, returning of the locking discs is arranged by means of one or several return bars 18 acting on the locking discs and receiving turning power from the key through one or several members turning with the key. The locking bar operating locking discs 5 can advantageously serve for the purpose. For this reason the top and/or the base of the key blade include returning surfaces 63 (FIGS. 8,22,26 and 31) acting on the stop faces 17 of the locking bar operating locking discs 5 located at one or both ends of the set of discs. The returning surfaces 63 force the locking bar operating locking discs to turn all along with the key as described above. Thus, when bringing the lock mechanism into the locking position the key acts, through the locking bar operating locking discs 5, on the return bars 18, which return the locking discs 7 into the locking position.

The embodiment shown in FIGS. 1–4 includes two return bars 18*a* and 18*b*, for which the inner cylinder 2 includes grooves 19*a* and 19*b*, the intermediate discs 6 include a broad peripheral notch 20, the locking discs 7 include a broad peripheral notch 22 provided with stop edges 21*a* and 21*b* and the locking bar operating locking disc 5 includes narrow peripheral notches 25*a* and 25*b* provided with guiding edges 23*a* and 23*b* and stop edges 24*a* and 24*b*.

The operation of the lock is analogous in both turning directions. In the following the operation of the lock is described in one turning direction with reference to FIG. 1.

When turning the key of the lock (not shown in FIG. 1) the intermediate discs 6 do not turn at all at the beginning of the turning movement. The locking discs 7 begin to turn independent of each other when the combination surface of the key contacts the respective stop face 12 of the locking disc 7. On the other hand the locking bar operating locking disc 5 turns immediately with the key when the key is turned. Accordingly, when turning the key for instance in a clock-wise direction the guiding edge 23*b* of the locking bar operating locking disc 5 acts on the return bar 18*b* pushing it up from the groove 19*b* into a groove formed jointly by the peripheral notch 25*b* of the locking disc 5, the broad peripheral notches 20 of the intermediate discs 6 and the broad peripheral notches 22 of the locking discs 7, and brings it to turn along with the locking bar operating locking disc 5 between the set of discs and the inner cylinder 2. Urged by separate spring elements 27 in the lock, located preferably at both ends of the set of discs and urging the return bars 18*a* and 18*b* as well as the locking bar 4 radially outwards, the return bar 18*a* is already located in the groove 19*a* of the inner cylinder 2. If the lock did not include spring elements 27 urging the return bars, the stop edge 24*a* of the locking bar operating locking disc 5 would act on the return bar 18, which would be guided into the groove 19*a* of the inner cylinder, because of stop edges 26*a* in the intermediate discs 6, still being in their initial position at this phase. Thus, if required, the operation of the return bars 18 could be positively guided all the way by only designing the peripheral notches of the discs in a suitable manner so as to minimize the friction due to the movements of the return bars relative to the set of discs. When turning the key further the return bar 18*b* reaches the return bar 18*a*. Simultaneously, however, one of the peripheral notches 16 of the locking bar operating locking disc 5, the others of the peripheral notches 9 of the locking discs 7 and the peripheral notches 13 of the intermediate discs jointly form a groove for the locking bar 4 to move into, thereby releasing the inner cylinder 2 relative to the cylinder housing 1. Consequently, both the inner cylinder 2, the locking bar 4 and the set of discs are free to be turned and this turning movement is transmitted into a mechanism, e.g. a door locking mechanism, which is operated by means of the cylinder lock in question.

When turning the key backwards it acts on the locking bar operating locking disc 5, which through the locking bar 4, turn the other members of the set of discs as well as the cylinder 2 relative to the cylinder housing 1. When the required power transmitting operations have been carried out by means of the inner cylinder 2, the locking bar 4 moves along with the locking bar operating locking disc 5 and the inner cylinder 2 until the position of the groove 3 of the cylinder housing 1. Then the locking bar 4 is urged back into the groove 3 of the cylinder housing preferably by means of said spring elements 27 located at both ends of the set of discs or possibly by means of a separate spring element for the locking bar (spring 45 in FIG. 7), and, at the same time, by making use of a suitably formed edge 28 of the peripheral notch 16 of the locking bar operating locking disc 5. As a consequence thereof the locking bar 4 prevents turning of the inner cylinder 2 relative to the cylinder housing 1. By further turning of the key into the same direction the stop edge 24*b* of the locking bar operating locking disc 5 begins to push the return bar 18*b* back towards the groove 19*b* of the inner cylinder 2. When moving the return bar 18, it simultaneously acts on the stop edge 21*b* of the locking discs 7 thereby forcing them to turn into their initial the lock mechanism locking position. The spring element 27 and, on the other hand, a projection 29 in the locking bar operating locking disc 5 prevent the other return bar 18*a* from moving away from the groove 19*a* during said turning movement.

Viewed from the point of the operational security of the lock it is of advantage that both ends of the set of discs are provided with a locking bar operating locking disc 5 and a spring element 27. FIG. 5 shows one way to attach the spring elements 27 to the return bars 18*a* and 18*b* which is based on holes 66 at the ends of the return bars. The peripheral notches 9 of the locking discs 7 need not be symmetrically located at both sides of the locking disc but they can be located at different parts in the periphery of the locking disc as shown in FIG. 4 (see also FIG. 21). Thereby the opening combination of the lock is different in the opposite operation directions. Further the periphery of the locking discs may be provided, in a way known per se, with shallow so called false peripheral notches 30 to improve the security of the lock against picking.

FIGS. 6–10 show a second embodiment of a disc cylinder lock according to the invention, operable in both turning directions and provided with only one return bar 18 for the locking discs 7, said return bar 18 being provided with a spring element 27 consisting of two parts and urging the return bar radially inwards. This embodiment requires a separate spring 45 urging the locking bar 4 radially outwards. As obvious from FIG. 7, the inner cylinder 2 includes a space 33 and, at the other end of the set of discs in respect of said space, a separate cylinder cover 32 for the spring elements 27. These constructional arrangements can also be applied to the embodiment including an inner cylinder and two return bars. In this case the question is in the first place of guiding the spring elements when they turn along with the set of discs. In the embodiment including only one return bar circular shoulders 34 and 35 can provide a support needed for stressing the spring elements 27. As further can be seen from FIG. 7, the inner cylinder 2 is blocked inside the cylinder housing by means of a locking ring 31.

The basic operation principles of the disc cylinder lock according to FIGS. 6–10 correspond to what is described above. At the initial position the return bar 18 is enclosed, urged by the spring elements 27, in either of the grooves formed jointly by the peripheral notches 25 (in FIG. 6 the peripheral notch 25*a*) of the locking bar operating locking discs 5, the broad peripheral notches 20 of the intermediate discs 6 and the broad peripheral notches 22 of the locking discs 7. With reference to the position shown in FIG. 6, when the key of the lock is turned into a counter clock-wise direction the return bar 18 moves with the locking bar operating locking discs 5 pushed by the guiding edge 23*a* thereof. The spring elements 27 prevent the return bar 18 from moving into the groove 19*b*. In other respects the operation of the lock corresponds to what is described above. When turning the key backwards, after the movement of the locking bar 4 to prevent turning of the inner cylinder 2 relative to the cylinder housing 1, the stop edges 24*a* of the locking bar operating locking discs 5 begin to push the return bar 18 back to its initial position at the position of groove 19*a*. Simultaneously, the return bar 18 acts on the stop edge 21*a* of the locking discs 7 thereby forcing the locking discs into their initial position.

Referring further to the position shown in FIG. 6, if the key is turned in a clock-wise direction the stop edges 24*a* of the locking bar operating locking discs 5 act on the return bar 18. In this position, on the other hand, the intermediate discs 6 cannot be turned whereby the stop edges 26*a* thereof prevent the return bar from turning. As a consequence thereof the stop edges 24*a* of the locking bar operating locking discs 5 press the return bar 18 into the groove 19*a* of the inner cylinder 2, wherein the return bar 18 remains because of the projection 29 when turning the locking bar operating locking discs 5, until at the position of the peripheral notches 25*b* of the locking bar operating locking discs 5 it is allowed, urged by the spring elements 27, to rise from said groove. Thereafter the operation of the lock is analogous to what is described above, with the exception that the return bar 18 finally moves, when turning the key backwards, at the position of the groove 19*b* of the inner cylinder 2, i.e. the return bar 18 is moved into another position relative to the set of discs.

FIGS. 11–21 show embodiments in which the discs in the set of discs are directly guided by the cylinder housing 1. At the locking position of the locking mechanism the locking bar 4 prevents directly by means of the intermediate discs 6 turning of the set of discs relative to the cylinder housing 1, as obvious from FIGS. 11,12,17 and 18. In other respects the actual lock operations are arranged in an analogous way compared to the embodiments described above. In the embodiment shown in FIGS. 11–16 the return bars 18*a* and 18*b* are guided by means of guiding grooves 50 of the locking bar operating locking discs 5 and guiding grooves 52 of the intermediate discs 6. These guiding grooves are provided with bottom portions 51*a* and 51*b* and respectively 55*a* and 55*b*. Further the guiding groove 52 of the intermediate discs 6 include lifting edges 54*a* and 54*b* and a guiding edge 53. The locking discs 7 include a slot 56 for the return bars with stop edges 57*a* and 57*b*. In the following the operation of the return bars of the lock is described.

When the lock mechanism is in the locking position the return bars 18*a* and 18*b* are located in the bottom portions 55*a* and 55*b* of the guiding groove 52 of the intermediate discs 6, said bottom portions forming a channel in the axial direction of the set of discs. When turning the key of the lock for instance in a clock-wise direction the locking bar operating locking discs turn along with the key, whereas the intermediate discs 6, the peripheral notches 13 of which are blocked against the locking bar, remain at this phase in their initial position. The lifting edge 54*b* of the guiding groove 52 of the intermediate discs then press the return bar 18*b* into the bottom portion 51*b* of the guiding groove 50 of the locking bar operating locking discs 5, in which it remains because of the guiding edge 53. The other return bar 18*a* remains all the time in the bottom portion 55*a* of the guiding groove 52 of the intermediate discs 6. Thereafter the operation of the lock is largely analogous to what has already been described of FIGS. 1–4. When turning the key backwards the return bar 18*b* turns the locking discs 7 by means of the stop edges 57*b* thereof back into their initial locking position, the return bar 18*b*, at the same time, being guided back into the channel formed jointly by the bottom portions 55*b* of the guiding grooves of the intermediate discs.

As obvious from FIG. 11, the lock includes a turnable power transmission element 48, from which turning power is transmitted to the mechanisms to be operated through a member 49. Naturally, this is carried out only after the lock is opened with the key so that the whole set of discs is released to be turnable relative to the cylinder housing 1. In this embodiment a locking ring 41 similar to the ring 31 is used for locking the power transmission element 48 inside the cylinder housing 1. For attachment of the lock to the place where it is to be operated it is provided with attachment means 46 having openings 47 for fastening elements, e.g. screws. Naturally, other kinds of fastening means and elements, known per se, could be used as well. The locking bar 4 can be loaded with a spring (as spring 45 in FIG. 7) urging it radially outwards relative to the set of discs. The locking bar is pushed back into the groove 3 of the cylinder housing by means of said spring and, at the same time, additionally by making use of the edge 28 in the peripheral notches 16 of the locking bar operating locking discs 5. The return bars 18*a* and 18*b* can be provided with a separate spring urging said bars in a radially outward direction. As shown in FIGS. 11 and 13, also spring elements can be used, corresponding to the spring elements 27 shown in FIGS. 1 and 5, acting on both the locking bar 4 and the return bars 18*a* and 18*b*, whereby no separate spring means corresponding to the spring 45 shown in FIG. 7 is needed for the locking bar 4.

Also in the embodiment according to FIGS. 11–16 it is possible and advantageous to have the operation of the return bars positively guided without any spring elements 27. In this case the locking bar 4 has to be provided with a separate spring as described above.

In the embodiment according to FIGS. 17–21 the discs in the set of discs are directly guided by the cylinder housing, too, but this embodiment includes only one return bar 18. FIGS. 17 and 18 show spring elements 27 which urge both the locking bar 4 and the return bar 18 radially outwards. The return bar 18 could be urged radially inwards as well, whereby the set of discs could include discs according to FIGS. 14–16. In this case, however, separate spring means, e.g. corresponding to the spring 45 in FIG. 7, is required for the locking bar 4.

The operation of the disc cylinder lock shown in FIGS. 17–21 corresponds, for the part of the operation of the return bar, the operation of the embodiment according to FIGS. 6–10, with the exception that the spring element 27 acts in opposite directions in these embodiments. In the initial position the return bar 18 is located in one of the bottom portions 55 (in FIG. 18 in the bottom portions 55*b*) of the guiding groove 52 of the intermediate discs 6 blocked by a guiding edge 39 of the locking bar operating locking discs 5. When turning the key in a clock-wise direction, at the position of FIG. 18, the return bar 18 is brought into the bottom portion 51*b* of the guiding groove 50 of the locking bar operating locking discs 5 and is moved further along the guiding groove 52 of the intermediate discs 6. The spring element 27, however, prevents the return bar from moving into the bottom portion 55*a* of the groove 52. The actual locking operations are analogous to what is described above. When turning the key backwards stop edges 40*b* in the locking bar operating locking discs 5 push the return bar 18 back into the initial position, in which it is located in the bottom portion 55*b* of the intermediate discs 6, simultaneously turning the locking discs 7 by means of the stop edges 57*b* thereof into their initial the lock mechanism locking position. If the key is turned in a counter clock-wise direction, at the position of FIG. 18, the return bar 18 at first remains in its position while the guiding groove 50 of the locking bar operating locking disc 5 moves relative to the return bar 18. When the bottom portion 51*a* of the guiding groove 50 has reached the position of the return bar 18, the spring element 27 urges the return bar into said bottom portion 51*a*. At the same time, obviously, the return bar moves away from the bottom portion 55*b* of the guiding groove 52 of the intermediate discs 6. When turning the key back the stop edges 40*a* of the locking bar operating locking discs 5 push the return bar 18 along the guiding groove 52 of the intermediate discs finally into the other bottom portion 55*a* of said guiding groove 52. In other respects the operation is analogous to what is described above.

In FIG. 21 different alternatives for locating the peripheral notches 9 of the locking discs 7 are indicated by dotted lines 36. By varying the location of the peripheral notches 9 an enormous amount of different opening combinations is obtained for the disc cylinder lock type.

FIGS. 22–24 and 26–28 show two advantageous embodiments of a key for the locks described above. The blade 61 of the key 60 includes two series of combination surfaces 62 so arranged that the lock can be opened by turning the key into whichever turning direction. As already noticed above the series of combination surfaces of a key need not be equal but they can be independent of each other, whereby the lock has a different opening combination in the opposite operation directions. The key includes also returning surfaces 63, which return the locking discs 7 into their initial position by means of the locking bar operating locking discs 5 and the return bars 18 as described above.

FIGS. 25 and 29 show the form of the key insertion opening in the cylinder housing for the embodiments of the key described above.

The key hole 37 in the cylinder housing is provided with guiding surfaces 64 allowing the insertion and the removal of the key only in a position corresponding to the initial position of the locking discs. By this means said positions can be detected with ease.

FIGS. 30 and 31 show a third embodiment of a key for a disc cylinder lock according to the invention including four series of combination surfaces in all, so arranged that those located diametrically relative to the longitudinal axis of the key correspond to each other. Thereby the key can be inserted into the lock in two separate positions, which are obtained by turning the key 180 degrees around its longitudinal axis. However, for the combination surfaces located adjacent each other and turning the same locking disc 7 into opposite turning directions the following restriction is valid: the sum of the combination steps must not exceed the maximum value of a combination step of the combination system. In FIG. 30 the combination steps are exemplified with numerals 0 . . . 5. The restriction in question implies in this case that the sum of the combination steps must not exceed the value 5. If, for instance, the value of a combination step is selected to be 1, the value of the combination step for turning the same locking disc into the opposite direction can be chosen at most to 4. The corresponding other combination value pairs of mutually complementing combination steps according to said restriction are (0;5), (2;3), (3;2), (4;1) and (5;0).

In FIG. 31 profile grooves 69 can be seen, located in that end 65 of the key which is to be inserted into the lock and determining the insertion positions and the removal positions of the key relative to the lock. By changing the location of the grooves 69 a numerous amount of new series of combination surfaces can further be obtained.

If required, the lock according to the invention can easily be transformed to be operable in only one operation direction. FIGS. 32–36 show by way of example some alternative constructions based on the embodiment of FIGS. 11–16. The other embodiments described above can be transformed to be operable in only one direction as well in an analogous way. A practical requirement is that turning of the set of discs from the initial position into the other direction is totally blocked so that the locking discs cannot be turned into an uncontrollable position, in which the lock may not be opened even with a correct key for the lock.

Figure 32:
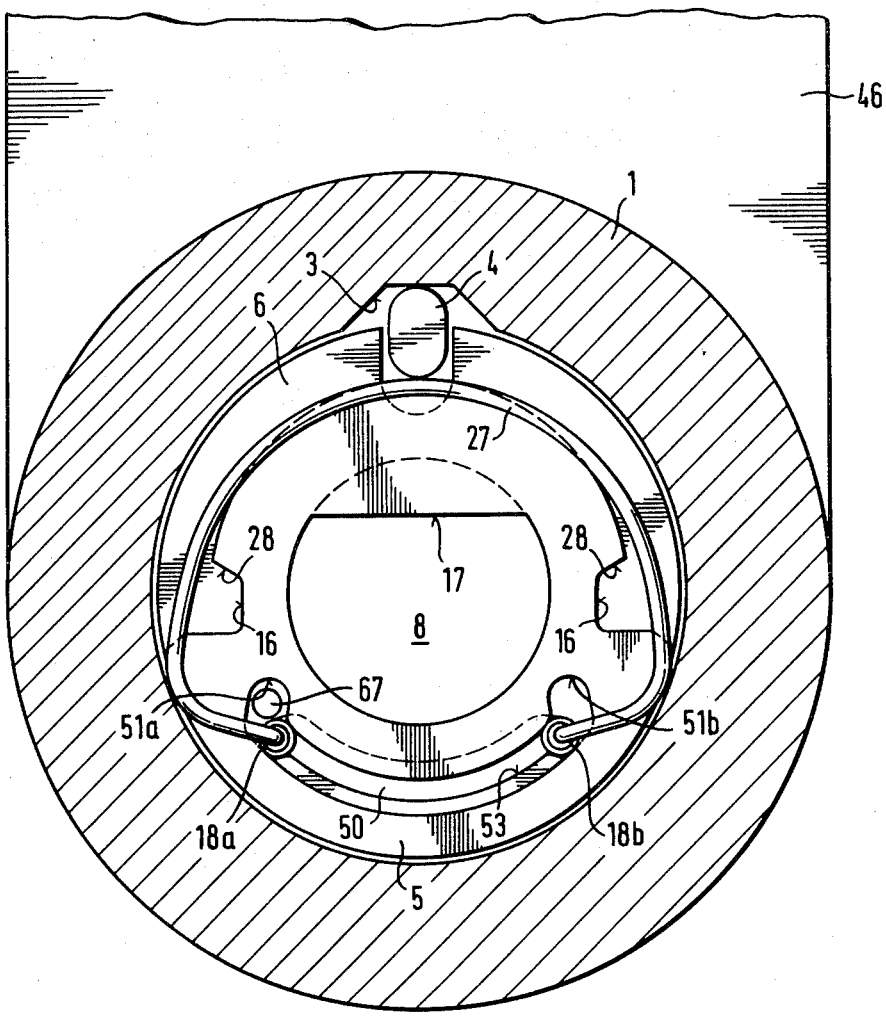

According to the embodiment of FIG. 32 a locking member 67 is placed into the bottom portion 51*a* of the guiding groove 50 of the locking bar operating locking disc 5 preventing the return bar 18*a* to move into said bottom portion 51*a* when trying to turn the locking disc 5 with the key of the lock into a counter clock-wise direction. As a consequence thereof the return bar 18*a* and the edges 54*a* (see FIG. 15) of the intermediate discs 6 block the locking discs 7 so that they cannot be turned in a counter clock-wise direction. Correspondingly, by placing the locking member 67 into the bottom portion 51*b* of the guiding groove 50 of the locking bar operating locking disc 5 the operation of the lock in a clockwise direction can be blocked. The locking member 67 can be, for instance, a ball-shaped or a plate-like body.

Figure 33:
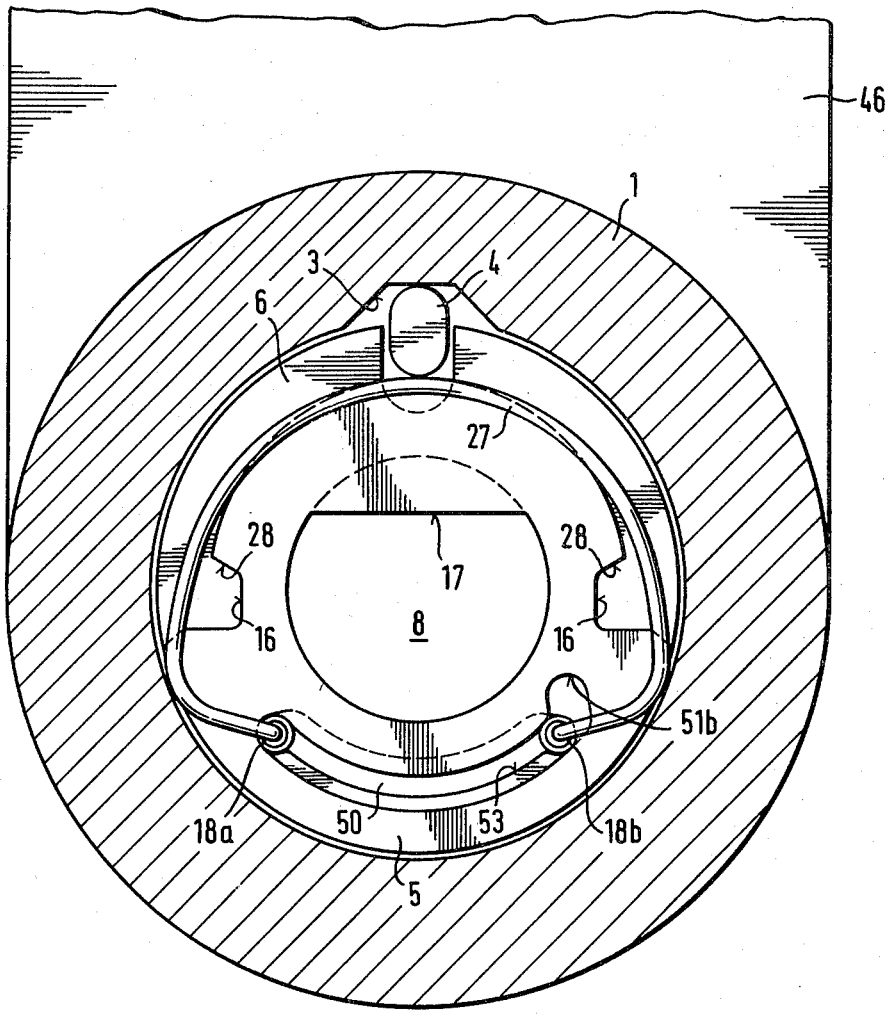
Figure 34:
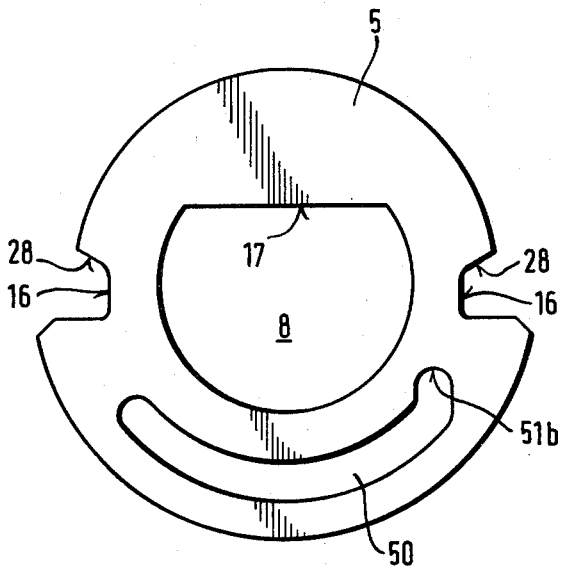

In the embodiment shown in FIG. 33 the guiding groove 50 of the locking bar operating locking disc 5 is redesigned, as more clearly shown in FIG. 34, by omitting the bottom portion 51*a*. The resulting effect corresponds to that of the construction shown in FIG. 32. The operation direction of the lock can be changed for instance by turning the locking disc 5 around in a way interchanging the faces thereof, so that the only bottom portion 51*b* of the guiding groove 50 is located at the position of the return bar 18*a*.

Figure 15:
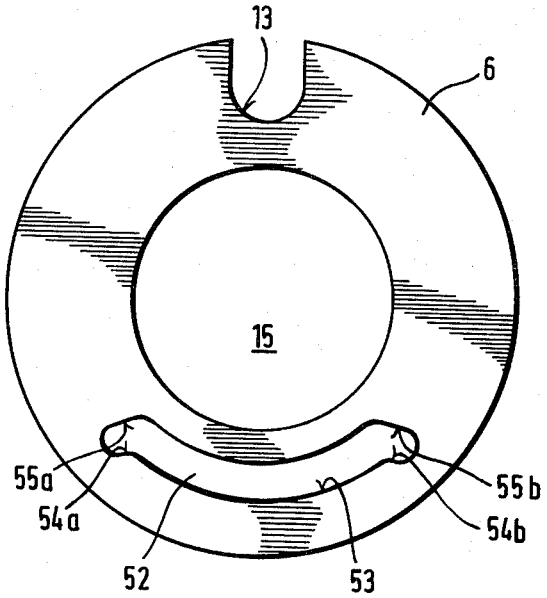
Figure 16:
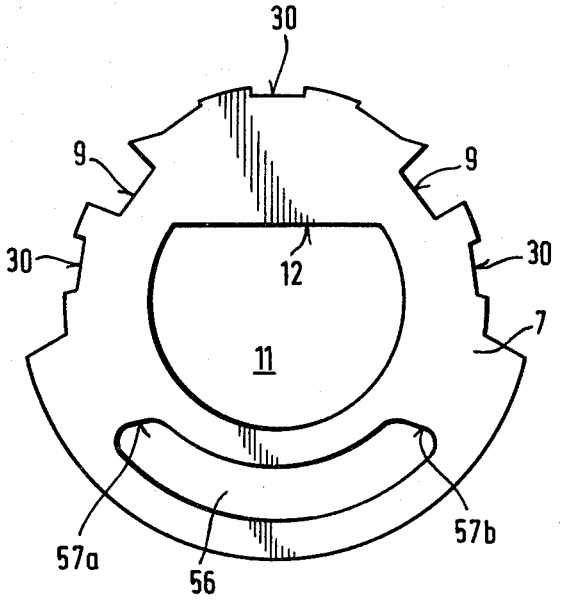
Figure 35:
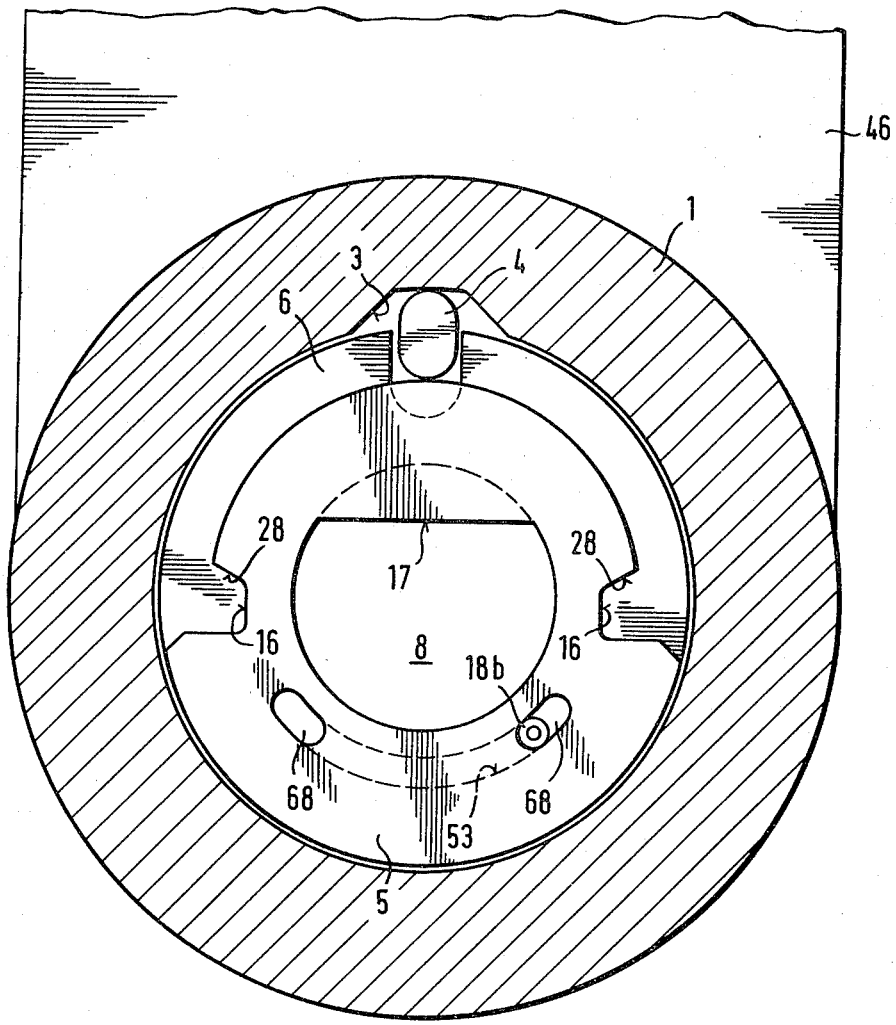
Figure 36:
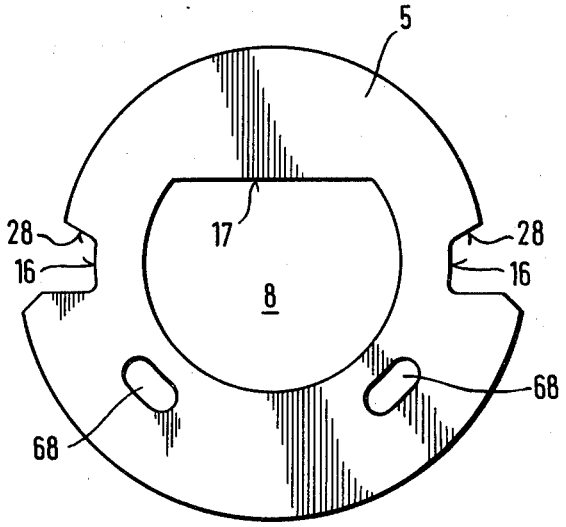

The guiding groove 50 of the locking bar operated locking disc 5 can also be redesigned as shown in FIGS. 35 and 36 so that merely holes 68 are made into the locking disc 5 for the return bars 18, located in the radial direction of the disc at the position of the guiding groove 52 of the intermediate disc 6 (see FIG. 15). The lock can be made to be operable in only one operation direction by further removing one of the return bars 18. In this case the operation direction of the lock can easily be changed by removing the return bar from one of the holes 68 of the locking bar operating locking disc 5 into the other. No spring element 27 shown in FIG. 13 is needed in this embodiment. This kind of redesigning of the locking bar operating locking disc 5, whereby said locking disc 5 is arranged continuously to guide the return bar substantially without interrelated movements of said members, can advantageously be adapted for the embodiments of the lock according to the invention including only one return bar.

The invention is not restricted to the embodiments described above but several modifications of the invention are feasible within the scope of the attached claims.

I claim:

1. A key operated cylinder lock including a hollow stationary cylinder housing enclosing a turnable power transmission element and a locking bar having a position locking the turning movement of said power transmission element relative to said cylinder housing, further a set of discs including a number of locking discs turnable by means of combination surfaces on a key of said lock, said locking discs being turnable, by the turning movement of said key, from an initial key insertion position to a releasing position, in which said power transmission element is released from its locked connection to the cylinder housing, the key of the lock being arranged to directly transmit a turning force to a number of locking discs only in a direction from said initial position to said releasing position, the returning of these locking discs to their initial position being arranged to be carried out by means of a separate return bar, receiving turning power from said key through one or several members turning with the key, said lock comprising means for guiding said return bar and said guiding means including means for allowing said return bar to move in the circumferential as well as in the radial direction of said lock.

2. A cylinder lock as claimed in claim 1, in which the correct turning angle, that is, the combination value of a number of locking discs is different in opposite turning directions.

3. A cylinder lock as claimed in claim 1 or 2, in which said cylinder housing includes a guiding surface which is arranged to allow insertion and the removal of the key only in a position corresponding to said initial position of the locking discs.

4. A cylinder lock as claimed in claim 1, including a hollow cylinder member connected, in a way known per se, to said power transmission element, the locking discs being arranged inside of said cylinder member, said return bar being arranged to move in a space between the peripheral edge of the locking discs and the inner surface of said hollow cylinder member.

5. A cylinder lock as claimed in claim 4, including two return bars being arranged to positively guide the returning movements of the locking discs, each return bar in its own returning direction.

6. A cylinder lock as claimed in claim 5, in which the return bars are arranged to guide the locking discs in the radial direction and the return bars in their basic position and the locking bar are mutually arranged so as to divide the periphery of the lock mechanism into three portions of at least substantially equal size.

7. A cylinder lock as claimed in claim 6, in which the return bars are urged by spring means, preferably in a direction radially outwards.

8. A cylinder lock as claimed in claim 7, in which said spring means is a flexible, rather a U-shaped or circle shaped spring element preferably urging also the locking bar in a direction radially outwards.

9. A cylinder lock as claimed in claim 7 or 8, in which the return bars are urged by spring means at both ends thereof.

10. A cylinder lock as claimed in claim 4, including only one return bar, which is urged by spring means in a direction radially inwards.

11. A cylinder lock as claimed in claim 1, in which the locking discs are, in a way known per se, directly guided by said cylinder housing, said return bar being guided by means of the locking discs and intermediate discs located between the locking discs.

12. A cylinder lock as claimed in claim 11, in which the locking discs and the intermediate discs include guiding edges jointly forming a closed channel and serving as guiding surfaces for said return bar.

13. A cylinder lock as claimed in claim 12, including two return bars being arranged to positively guide the returning movement of the locking discs, each return bar in its own returning direction.

14. A cylinder lock as claimed in claim 13, in which the return bars are urged by a spring preferably in a direction radially outwards.

15. A cylinder lock as claimed in claim 11 or 12, including only one return bar, being urged by spring means preferably in a direction radially outwards.

16. A cylinder lock as claimed in claim 1, in which the cross section of the return bar is substantially circular.

17. A cylinder lock as claimed in claim 1, in which turning of the return bar relative to the set of discs is blocked in one operation direction of the lock to prevent the operation of the lock in said operation direction.

18. A cylinder lock as claimed in claim 17, in which said blocking of the return bar is arranged by means of a separate locking member, which together with said return bar blocks turning of the set of discs thereby preventing operation of the lock in said operation direction.

19. A cylinder lock as claimed in claim 17, in which said power transmitting member turnable with the key includes guiding edges for the return bar, said guiding edges being suitably formed so as to block turning of the return bar in said turning direction, said return bar thereby blocking turning of the set of discs and preventing operation of the lock in said operation direction.

20. A key for a cylinder lock as claimed in claim 1, the basic form of that portion of the key which is to be inserted into the lock being a hollow cylinder having an axial groove, from both edges of which portions of different size are removed for obtaining the combination surfaces of the key.

21. A key for a cylinder lock as claimed in claim 1, the basic form of that portion of the key which is to be inserted into the lock corresponding to a cylinder, from which a cylinder segment, preferably two cylinder segments of different size, is cut away.

22. A key for a cylinder lock as claimed in claim 1, the basic form of that portion of the key which is to be inserted into the lock corresponding to a cylinder, from both sides of which portions, e.g. cylinder segments, of equal size are cut away, and the blade of the key thereby obtained being provided with four series of combination surfaces, which are located symmetrically relative to the longitudinal axis of the key and of which the ones located diametrically relative to the blade of the key are equal.

* * * * *

UNITED STATES PATENT OFFICE

CERTIFICATE OF CORRECTION

Patent No. B1 4,351,172 Dated August 5, 1986

Inventor(s) Kaarlo Martikainen

It is certified that error appears in the above-identified patent and that said Letters Patent are hereby corrected as shown below:

Claim 1, line 16 of the Reexamination Certificate, following "directions", insert --,--.

Claim 1, line 20 of the Reexamination Certificate, following "with" insert --the--.

Signed and Sealed this

Eighth Day of September, 1987

*Attest:*

DONALD J. QUIGG

*Attesting Officer*

*Commissioner of Patents and Trademarks*

REEXAMINATION CERTIFICATE (549th)

United States Patent [19]

Martikainen

[11] B1 4,351,172

[45] Certificate Issued Aug. 5, 1986

[54] CYLINDER LOCK MECHANISM

[75] Inventor: Kaarlo Martikainen, Mastotie, Finland

[73] Assignee: Oy Wartisila AB, Helsinki, Finland

Reexamination Request:
No. 90/000,896, Oct. 31, 1985

Reexamination Certificate for:

| | |
|---|---|
| Patent No.: | **4,351,172** |
| Issued: | **Sep. 28, 1982** |
| Appl. No.: | **181,803** |
| Filed: | **Aug. 27, 1980** |

[30] Foreign Application Priority Data

Sep. 7, 1979 [FI] Finland ..... 792797

[51] Int. Cl.[4] ..... E05B 29/02

[52] U.S. Cl. ..... 70/366; 70/402

[58] Field of Search ..... 70/365, 366, 358, 362, 70/376, 377, 402, 403, 404

[56] References Cited

U.S. PATENT DOCUMENTS

| | | | |
|---|---|---|---|
| 2,690,070 | 9/1954 | Spain | 70/358 |
| 3,789,638 | 2/1974 | Roberts et al. | 70/366 |
| 3,905,213 | 9/1975 | Roberts | 70/368 |
| 4,109,495 | 8/1978 | Roberts | 70/365 |
| 4,109,497 | 8/1978 | Roberts | 70/403 |
| 4,111,021 | 9/1978 | Roberts | 70/406 |

FOREIGN PATENT DOCUMENTS

| | | |
|---|---|---|
| 85422 | 10/1970 | Brazil . |
| 1165830 | 6/1958 | France . |
| 2426135 | 12/1979 | France . |

OTHER PUBLICATIONS

"Novalinea and Miramar Locks", Catalog of the Papaiz Lock Company of Brazil (2 pages), undated.

*Primary Examiner*—Robert L. Wolfe

[57] ABSTRACT

A key operated cylinder lock is disclosed, including a hollow stationary cylinder housing enclosing a turnable power transmission element and a locking bar having a position locking the turning movement of said power transmission element relative to said cylinder housing. The cylinder lock further includes a set of discs including a number of locking discs turnable by means of combination surfaces on a key of said lock, the locking discs being turnable, by the turning movement of said key, from an initial key insertion position to a releasing position, in which the power transmission element is released from its locked connection to the cylinder housing, whereby the key of the lock is arranged to directly transmit a turning force to a number of locking discs only in a direction from said initial position to said releasing position. The returning of these locking discs to their initial position is arranged to be carried out by means of a separate return bar, receiving turning power from said key through one or several members turning with the key. Thereby the lock is operable in both turning directions and, in addition, the correct turning angle, that is the combination value of a number of locking discs, can be different in opposite turning directions. The separate return bar is movable in a circumferential as well as a radial direction of the lock.

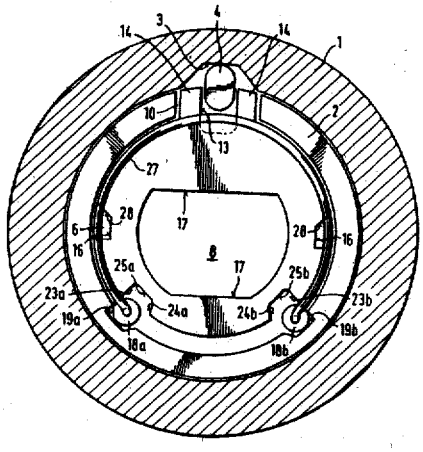

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–22, dependent on an amended claim, are determined to be patentable.

1. A key operated cylinder lock including a hollow stationary cylinder housing enclosing a turnable power transmission element and a locking bar having a position locking the turning movement of said power transmission element relative to said cylinder housing, further a set of discs including a number of locking discs turnable by means of combination surfaces on a key of said lock, said locking discs being turnable, by the turning movement of said key, from an initial key insertion position to a releasing position, in which said power transmission element is released from its locked connection to the cylinder housing, the key of the lock being arranged to directly transmit a turning force to a number of locking discs only in a direction from said initial position to said releasing position, *one or several members turnable with the key in both directions* the returning of these locking discs to their initial position being arranged to be carried out by means of a separate return bar, receiving turning power from said key through *said* one or several members turning with key, said lock comprising means for guiding said return bar and said guiding means including means for allowing said return bar to move in the circumferential as well as in the radial direction of said lock.

* * * * *